US006164925A

United States Patent [19]

Yokomachi et al.

[11] Patent Number: 6,164,925

[45] Date of Patent: Dec. 26, 2000

[54] CONTROL VALVE FOR VARIABLE DISPLACEMENT COMPRESSORS

[75] Inventors: Naoya Yokomachi; Toshiro Fujii; Kazuo Murakami; Yoshiyuki Nakane, all of Kariya, Japan

[73] Assignee: Kabushiki Kaisha Toyoda Jidoshokki Seisakusho, Kariya, Japan

[21] Appl. No.: 09/218,677

[22] Filed: Dec. 22, 1998

[30] Foreign Application Priority Data

| | | | |
|---|---|---|---|
| Dec. 26, 1997 | [JP] | Japan | 9-361257 |
| Apr. 20, 1998 | [JP] | Japan | 10-109274 |
| Dec. 7, 1998 | [JP] | Japan | 10-347207 |

[51] Int. Cl.[7] ..... F04B 1/26

[52] U.S. Cl. ..... 417/222.2; 417/222

[58] Field of Search ..... 417/222, 222.2, 417/270, 269; 62/133

[56] References Cited

U.S. PATENT DOCUMENTS

| | | | |
|---|---|---|---|
| 4,428,718 | 1/1984 | Skinner | 417/222 |
| 4,606,705 | 8/1986 | Parekh | 417/222 |
| 4,685,866 | 8/1987 | Takenaka et al. | 417/222 |
| 4,752,189 | 6/1988 | Bearint et al. | 417/222 |
| 4,819,440 | 4/1989 | Nakajima et al. | 62/133 |
| 4,842,488 | 6/1989 | Terauchi | 417/222 |
| 4,846,630 | 7/1989 | Fujii et al. | 417/222 |
| 4,936,752 | 6/1990 | Terauchi | 417/222 |
| 5,000,666 | 3/1991 | Esaki | 417/222 |
| 5,152,673 | 10/1992 | Pettitt et al. | 417/222.2 |
| 5,531,572 | 7/1996 | Kimura et al. | 417/222.2 |
| 5,547,346 | 8/1996 | Kanzaki et al. | 417/222.2 |
| 5,620,310 | 4/1997 | Takenaka et al. | 417/222.2 |
| 5,685,160 | 11/1997 | Abersfelder et al. . | |
| 5,785,502 | 7/1998 | Ota et al. | 417/222.2 |
| 5,964,578 | 10/1999 | Suitou et al. | 417/222.2 |
| 6,010,312 | 1/2000 | Suitou et al. | 417/222.2 |
| 6,033,189 | 3/2000 | Miura et al. | 417/222.2 |
| 6,036,447 | 3/2000 | Kawaguchi et al. | 417/222.2 |

FOREIGN PATENT DOCUMENTS

| | | |
|---|---|---|
| 6-341378 | 12/1994 | Japan . |
| 8-110104 | 4/1996 | Japan . |
| 9-268973 | 10/1997 | Japan . |
| 9-280171 | 10/1997 | Japan . |

*Primary Examiner*—Teresa Walberg
*Assistant Examiner*—Leonid Fastovsky
*Attorney, Agent, or Firm*—Morgan & Finnegan, L.L.P.

[57] ABSTRACT

A control valve for controlling displacement of a variable displacement compressor having a suction chamber, a discharge chamber, a control chamber, and a pressurizing passage. The control valve adjusts the amount of refrigerant sent to the control chamber from the discharge chamber to control the compressor displacement. The control valve includes a valve body for adjusting the opened area of the pressurizing passage. A solenoid urges the valve body in a first direction with a force corresponding to the value of the current fed to the solenoid. A first and second pressure chamber are partitioned by a diaphragm in the valve. A target value of the pressure difference between the first and second pressure chambers is determined by the urging force of the solenoid. For a given constant solenoid current, the compressor seeks the target value that corresponds to that current. The solenoid requires only a relatively small current range, even if carbon dioxide is used as the refrigerant. Also, the valve minimizes the compressor displacement when it receives no current.

11 Claims, 5 Drawing Sheets

CONTROL VALVE FOR VARIABLE DISPLACEMENT COMPRESSORS

BACKGROUND OF THE INVENTION

The present invention relates to displacement control valves employed in variable displacement compressors to control compressor displacement. More particularly, the present invention relates to control valves for controlling the amount of refrigerant gas flowing into a control chamber from a discharge pressure zone in a variable displacment compressor.

A variable displacement compressor generally has a housing that housed a control chamber and a rotatable drive shaft. Cylinder bores extend through a cylinder block, which forms part of the housing. A piston is retained in each cylinder bore. A swash plate is supported on the drive shaft in the control chamber. The swash plate is permitted to incline with respect to the drive shaft while rotating integrally with the drive shaft. Each piston is coupled to the swash plate. The rotation of the swash plate reciprocates each piston. This draws refrigerant gas into the associated cylinder bore from a suction chamber, compresses the refrigerant gas, and then discharges the compressed refrigerant gas into a discharge chamber. The inclination of the swash plate is altered in accordance with the difference between the pressure of the cylinder bores and the pressure of the control chamber. The inclination of the swash plate is smaller when the pressure difference is larger. That is, the inclination of the swash plate decreases as the pressure of the cylinder bores becomes smaller relative to the pressure of the control chamber. A decrease in the inclination of the swash plate shortens the stroke of the pistons and decreases the displacement of the compressor.

A typical variable displacement compressor incorporates a control valve to control the amount of refrigerant gas flowing between the control chamber and the discharge chamber. For example, a control valve 1, which is shown in FIG. 6, is employed to control the amount of refrigerant gas that flows into the control chamber from the discharge chamber. A pressure sensing element, or diaphragm 2, is housed in the control valve 1. An atmospheric pressure chamber 8 is defined on one side of the diaphragm 2 and a suction pressure chamber 9 is defined on the other side of the diaphragm 2. The pressure of the suction chamber (suction pressure) is communicated to the suction pressure chamber 9. A spring 3 is arranged in the atmospheric pressure chamber 8. The control valve 1 further includes a valve hole 5 and a solenoid 6. The opened area of the valve hole 5 is adjusted by a valve body 4, which is connected to the diaphragm 2. The diaphragm 2 urges the valve body 4 in a direction opening the valve hole 5. A further spring 10 urges the valve body 4 in a direction closing the valve hole 5. The solenoid 6, when excited, also urges the valve body 4 by means of a rod 7 in the direction closing the valve hole 5 with a force corresponding to the current fed to the solenoid 6.

The opened area of the valve hole 5 is determined by the position of the valve body 4 with respect to the valve hole 5. The position of the valve body 4 is determined by the balance between the force that urges the valve body 4 away from the valve hole 5, or in an opening direction, and the force that urges the valve body 4 toward the valve hole 5, or in a closing direction. The force urging the valve body 4 in the opening direction is produced by the difference between the force applied to one side of the diaphragm 2 by the pressure in the atmospheric pressure chamber 8 and the force of the spring 3 and the force applied to the other side of the diaphragm 2 by the suction pressure in the suction pressure chamber 9. The force urging the valve body 4 in the closing direction is produced by the sum of the force of the solenoid 6 and the force of the spring 10.

When the current fed to the solenoid 6 is maintained at a constant value, that is, when the force of the solenoid 6 is constant, the valve body 4 moves in accordance with the fluctuation of the suction pressure. More specifically, an increase in the suction pressure decreases the opened area of the valve hole 5 and decreases the amount of refrigerant gas sent to the control chamber from the discharge chamber. This lowers the pressure of the control chamber, decreases the difference between the pressure in the control chamber and the pressure in the cylinder bores, and increases the inclination of the swash plate. As a result, the displacement of the compressor increases, which gradually decreases the suction pressure. On the other hand, a decrease in the suction pressure increases the opened area of the valve hole 5. This decreases the displacement of the compressor, which gradually raises the suction pressure. Accordingly, the control valve 1 functions to maintain the suction pressure in a constant state.

The control valve 1 also adjusts the target value of the suction pressure in accordance with the value of the current fed to the solenoid 6. For example, if the force of the solenoid 6 increases as the value of the current flowing through the solenoid 6 increases, the force urging the valve body 4 in the closing direction increases. Accordingly, the opened area of the valve hole 5 decreases and lowers the pressure of the control chamber. This gradually decreases the suction pressure. In other words, the control valve 1 maintains the suction pressure at a lower value, or lowers the target value, as the value of the current fed to the solenoid 6 increases. Accordingly, the control valve 1 functions to alter the target suction pressure in accordance with the value of the current fed to the solenoid 6.

The force of the solenoid 6 must be permitted to change within a range that corresponds to the fluctuation range of the suction pressure in the suction pressure chamber 9. In other words, the value range of the current fed to the solenoid 6 must be substantially proportional to the fluctuation range of the suction pressure. Japanese Unexamined Patent Publication No. 8-110104 describes a compressor that employs carbon dioxide ($CO_2$) as a refrigerant. In such a compressor, the pressure of the refrigerant is ten or more times higher than that of a compressor using chlorofluorocarbon as the refrigerant. Thus, the fluctuating range of the suction pressure is much wider in a compressor using $CO_2$. Accordingly, the solenoid 6 must be excited within a wide current altering range to correspond to the wide fluctuating range of the suction pressure. To tolerate such wide current altering range, a large control valve 1 must be employed. However, this increases the size and weight of the compressor.

Japanese Unexamined Patent Publication No. 6-341378 describes a variable displacement compressor that employs an electromagnetic control valve that adjusts the difference between the pressure of the control chamber and the pressure of the suction chamber to an arbitrary constant value. This control valve also has two pressure chambers, which are partitioned from each other by a pressure sensing element. The pressure of the control chamber is communicated to one chamber, while the pressure of the suction chamber is communicated to the other chamber. The pressure sensing element moves the valve body in accordance with the fluctuations of the pressure in the control chamber and the pressure in the suction chamber. This maintains a constant difference between the pressure of the control chamber and the pressure of the suction chamber. Furthermore, the target pressure difference is varied in accordance with the value of the current fed to an electromagnetic solenoid, which is arranged in the control valve.

This control valve need only alter the value of the current fed to the solenoid within a range that corresponds to the fluctuating range of the pressure difference. The fluctuation range of the pressure difference is much more narrow than the fluctuation range of the suction pressure. This permits the range of the current fed to the solenoid to be much more narrow that of the control valve illustrated in FIG. 6. Thus, a smaller control valve can be employed.

However, in this control valve, an increase in the pressure of the suction chamber, or an increase in the thermal load (cooling load), opens the valve more. This increases the amount of refrigerant gas that flows into the control chamber from the discharge chamber. Therefore, the pressure in the control chamber increases in accordance with the increase of the pressure in the suction chamber. So the increase in the displacement of the compressor does not occur when the pressure in the suction chamber increases. An increase in the thermal load leads to an increase in displacement. However, the control valve keeps approximately the same displacement as the thermal load increases. This prevents the control valve from being employed to control displacement by directly using suction pressure, which reflects the thermal load. To control displacement in accordance with the suction pressure, a sensor can be employed to detect the suction pressure and output a corresponding electric signal. In this case, the signal is sent to a controller that controls the electric current fed to the solenoid based on the suction pressure. However, such a structure is complicated.

SUMMARY OF THE INVENTION

Accordingly, it is an objective of the present invention to provide a control valve that is compact and facilitates displacement control even when carbon dioxide ($CO_2$) is used as the refrigerant.

To achieve the above objective, the present invention provides a control valve for controlling displacement of a variable displacement compressor. The compressor includes a suction pressure zone, the pressure of which is a suction pressure, a discharge pressure zone, a control chamber, the pressure of which is a control pressure, and a pressurizing passage through which refrigerant is sent to the control chamber from the discharge pressure zone. The control valve adjusts the amount of refrigerant sent to the control chamber from the discharge pressure zone to control the compressor displacement. The control pressure is raised and the compressor displacement is decreased when the amount of refrigerant sent to the control chamber from the discharge pressure zone increases. The control pressure is lowered and the compressor displacement is increased when the amount of refrigerant sent to the control chamber from the discharge pressure zone decreases. The control valve includes a valve body for adjusting the opened area of the pressurizing passage. An electric drive means urges the valve body in a first direction with a force corresponding to the value of the current fed to the electric drive means. The control valve further includes a first pressure chamber to which the control pressure of the control chamber is communicated, a second pressure chamber to which the suction pressure of the suction pressure zone is communicated, and a pressure sensing element partitioning the first pressure chamber and the second pressure chamber from each other. The difference between the pressure of the first pressure chamber and the pressure of the second pressure chamber produces a force that causes the pressure sensing element to urge the valve body in a second direction, which is opposite to the first direction. A target value of the pressure difference between the first and second pressure chambers is determined by the urging force of the electric drive means. The pressure sensing element moves the valve body to decrease the opened area of the pressurizing passage and return the pressure difference to the target value when the suction pressure communicated to the second pressure chamber increases. The pressure sensing element moves the valve body to increase the opened area of the pressurizing passage and return the pressure difference to the target value when the suction pressure communicated to the second pressure chamber decreases.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 4(*b*) is an enlarged cross-sectional view showing the displacement control valve of FIG. 1 in a closed state;

FIG. 5(*b*) is a graph illustrating the relationship of the solenoid current relative to the suction pressure and the control pressure.

DETAILED DESCRIPTION OF THE PREFERRED EMBODIMENTS

A displacement control valve according to the present invention will now be described with reference to FIGS. 1 to 5.

Figure 1:
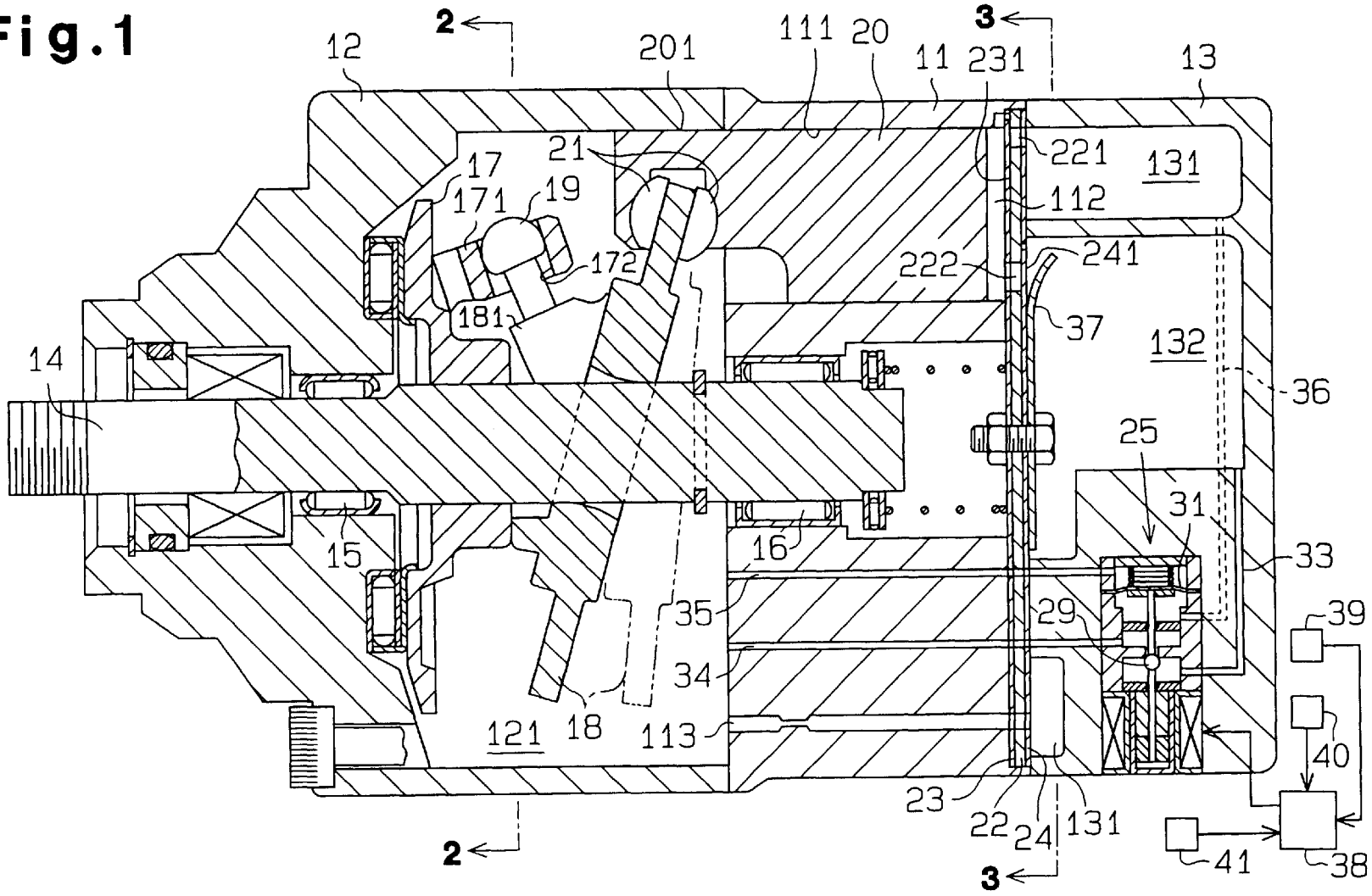
FIG. 1 is a cross-sectional view showing a compressor according to the present invention.

As shown in FIG. 1, a front housing 12 and a rear housing 13 are fixed to a cylinder block 11. The cylinder block 11 and the front housing 12 rotatably support a drive shaft 14 by means of radial bearings 15, 16. The drive shaft 14 is driven by an automotive engine. A control chamber 121 is defined in the front housing 12 in front of the cylinder block 11.

Figure 2:
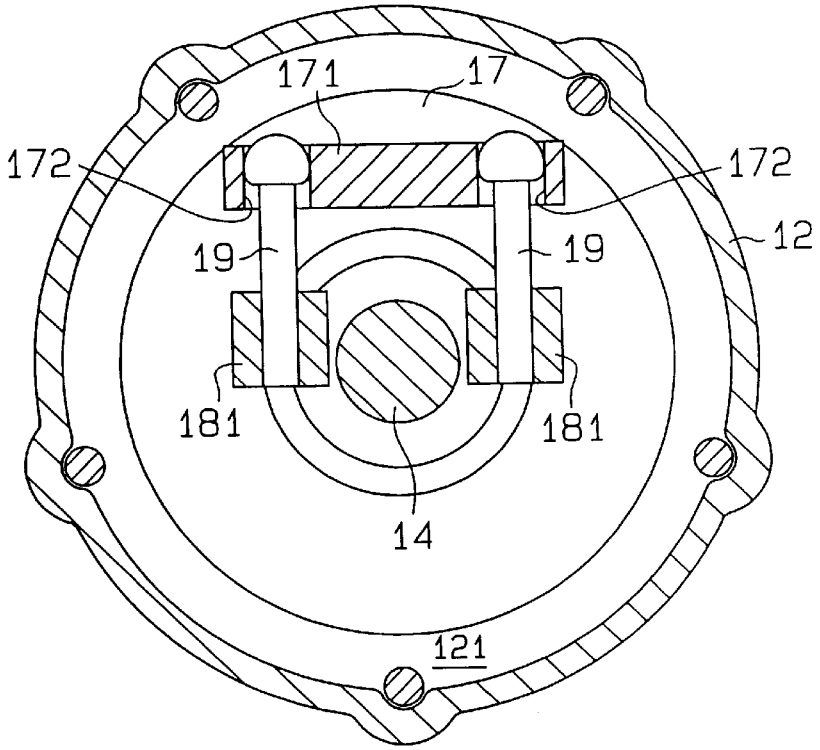
FIG. 2 is a cross-sectional view taken along line 2—2 in FIG. 1.

A disk-like rotor 17 is fixed to the drive shaft 14 in the control chamber 121. As shown in FIGS. 1 and 2, a support arm 171 having a pair of guide bores 172 extends from the peripheral portion of the rotor 17. A swash plate 18 is supported on the drive shaft 14 in the control chamber 121.

The swash plate 18 is permitted to incline with respect to and slide along the drive shaft 14. A pair of guide arms 181 are attached to the swash plate 18. A guide pin 19 is secured to the distal end of each guide arm 181. Each guide pin 19 engages the associated guide bore 172. The engagement between the guide bores 172 and the associated guide pins 19 guides the inclination of the swash plate 18 and rotates the swash plate 18 integrally with the drive shaft 14.

Cylinder bores 111 extend through the cylinder block 11. Each cylinder bore 111 accommodates a piston 20. Each piston 20 defines a compression chamber 112 in the associated cylinder bore 111. The piston 20 is coupled to the swash plate 18 by a pair of shoes 21. The rotation of the swash plate 18 is converted to reciprocation of the piston 20 in the cylinder bore 111 by means of the shoes 21.

Figure 3:
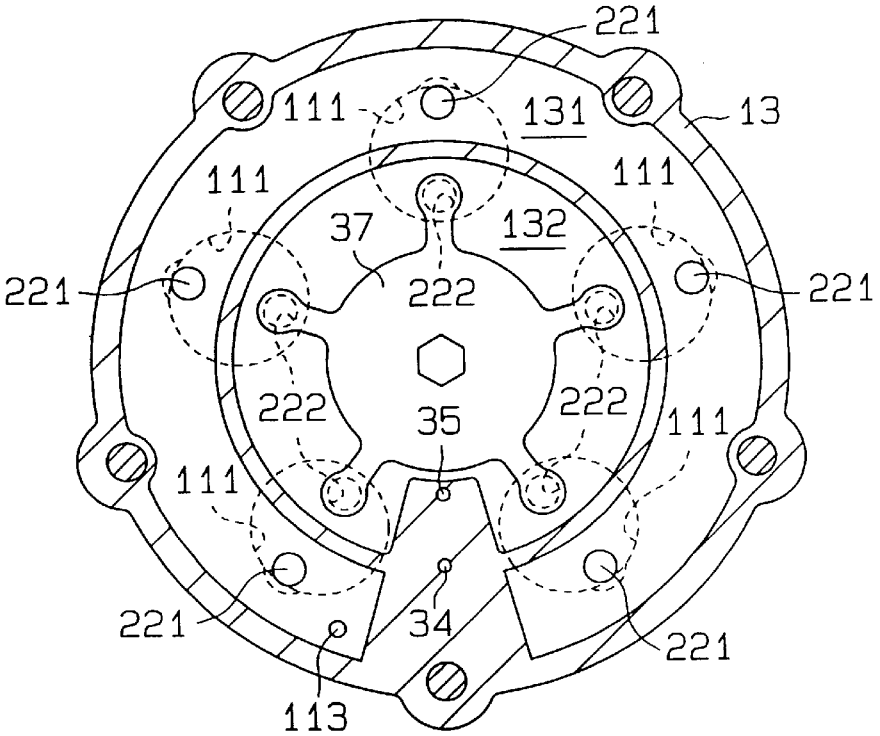
FIG. 3 is a cross-sectional view taken along line 3—3 in FIG. 1.

As shown in FIGS. 1 and 3, a suction pressure zone, or suction chamber 131, and a discharge pressure zone, or discharge chamber 132, are defined in the rear housing 13. A partition plate 22 and a pair of valve plates 23, 24 are arranged between the cylinder block 11 and the rear housing 13. A suction port 221 and a discharge port 222 are provided for each cylinder bore 111 on the partition plate 22. A suction flap 231 is provided for each suction port 221 on the valve plate 23 to open and close the suction port 221. A discharge flap 241 is provided for each discharge port 222 on the valve plate 24 to open and close the discharge port 222. A retainer 37 limits the opening degree of the discharge flap 241. When each piston 20 moves from its top dead center position to its bottom dead center position, refrigerant gas is drawn into the corresponding suction port 221 from the suction chamber 131 thereby opening the suction flap 231 to enter the associated compression chamber 112. When the piston 20 moves from the bottom dead center position to the top dead center position, the refrigerant gas compressed in the compression chamber 112 opens the corresponding discharge flap 241 and flows into the discharge chamber 131 through the associated discharge port 222.

The inclination of the swash plate 18 varies in accordance with the difference between the pressure of the control chamber 121 and the pressure of the compression chambers 112. More specifically, the difference between the pressure of the control chamber 121 (control pressure Pc) and the pressure of the suction chamber 131 (suction pressure Ps), or the pressure difference Pc−Ps, determines the inclination of the swash plate 18. In this compressor, the control pressure Pc is maintained at a value that is higher than the suction pressure Ps (Pc>Ps). An increase in the pressure difference Pc-Ps decreases the inclination of the swash plate 18. This shortens the stroke of each piston 20 and decreases the displacement of the compressor. On the other hand, a decrease in the pressure difference Pc−Ps increases the inclination of the swash plate 18. This lengthens the stroke of each piston 20 and increases the displacement.

As shown in FIG. 1, a displacement control valve 25 is arranged in the rear housing 13 to control the flow of refrigerant gas from the discharge chamber 132 to the control chamber 121. The refrigerant gas in the control chamber 121 flows through a pressure relief passage 113, which has a throttle, and then enters the suction chamber 131. The pressure in the control chamber 121 is determined by two factors. The first factor is the flow rate of refrigerant gas sent out of the control chamber 121 and into the suction chamber 131 through the relief passage 113. The second factor is the flow rate of refrigerant gas sent into the control chamber 121 from the discharge chamber 132 by way of the control valve 25.

Figure 4:
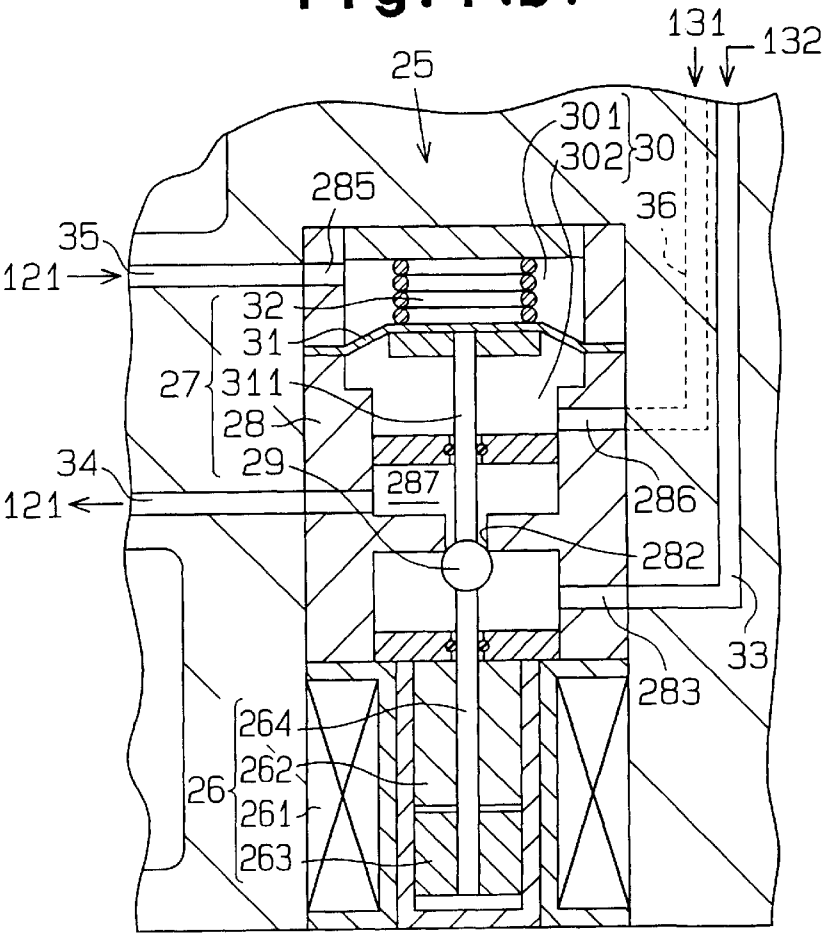
FIG. 4(*a*) is an enlarged cross-sectional view showing the displacement control valve of FIG. 1 in an opened state.
Figure 4:
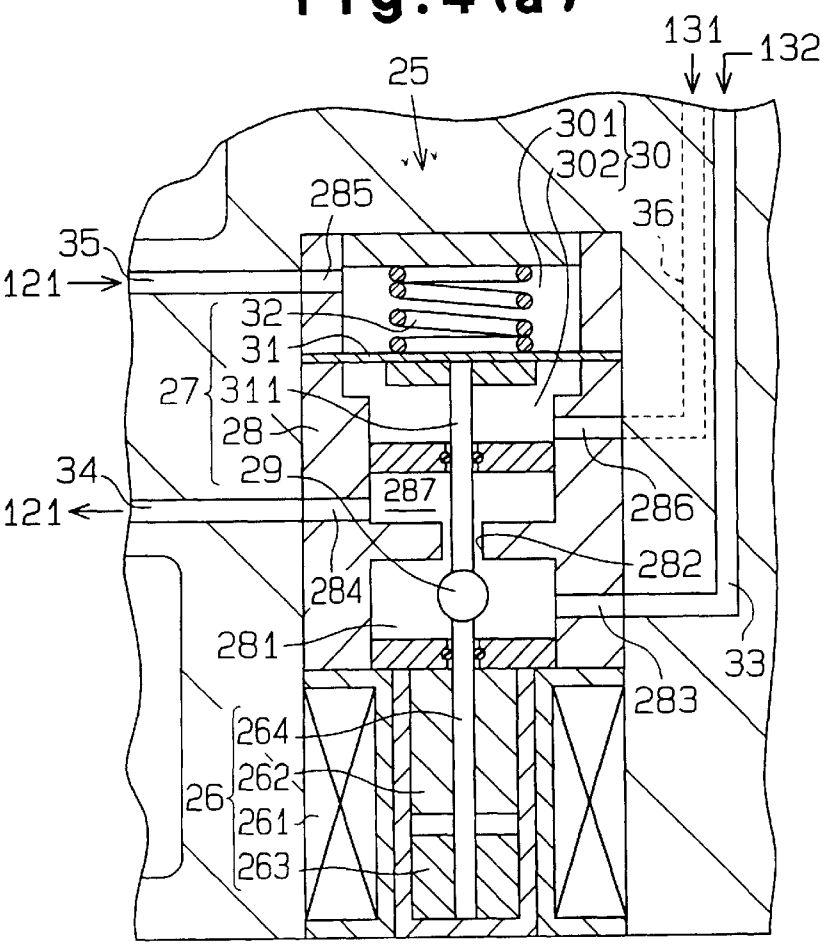

As shown in FIGS. 4(*a*) and 4(*b*), the displacement control valve 25 has a solenoid 26, which serves as an electric drive means, and a valve mechanism 27. The solenoid 26 includes a coil 261, a steel fixed core 262, a steel movable core 263, and a drive rod 264, which is secured to the movable core 263. The valve mechanism 27 includes a case 28, a valve chamber 281 housed in the case 28, a valve body 29 accommodated in the valve chamber 281, a pressure compartment 30 housed in the case 28, a pressure sensing element, or diaphragm 31, accommodated in the pressure compartment 30, a transmission rod 311 attached to the diaphragm 31, and a spring 32. The diaphragm 31 partitions the pressure compartment 30 into a first pressure chamber 301 and a second pressure chamber 302. The spring 32 is located in the first pressure chamber 301. A valve hole 282 extends between the valve chamber 281 and a gas flow chamber 287 defined in the case 28. The transmission rod 311 extends through the valve hole 282 and the gas flow chamber 287 to connect the valve body 29 to the diaphragm 31. The drive rod 264 extends through the fixed core 262 to be in contact with the valve body 29.

When the coil 261 is supplied with electric current, an electromagnetic attractive force is generated between the movable core 263 and the fixed core 262. Thus, the drive rod 264, which is secured to the movable core 263, urges the valve body 29 in a direction closing the valve hole 282. The spring 32 urges the valve body 29 in a direction opening the valve hole 282 by means of the diaphragm 31 and the transmission rod 311.

The case 28 includes a first port 283, a second port 284, a third port 285, and a fourth port 286. The first port 283 is connected to a first passage 33 extending through the rear housing 13. The second port 284 is connected to a second passage 34 extending through the rear housing 13 and the cylinder block 11. The third port 285 is connected to a third passage 35 extending through the rear housing 13 and the cylinder block 11. The fourth port 286 is connected to a fourth passage 36 extending through the rear housing 13. Thus, the valve chamber 281 is connected to the discharge chamber 132 through the first port 283 and the first passage 33. The valve hole 282 is connected to the control chamber 121 through the gas flow chamber 287, the second port 284, and the second passage 34. FIG. 4(*a*) shows the valve hole 282 in an opened state. In this state, the high-pressure refrigerant gas in the discharge chamber 132 is sent to the control chamber 121 through a pressurizing passage, which is formed by the first passage 33, the first port 283, the valve chamber 281, the valve hole 282, the gas flow chamber 287, the second port 284, and the second passage 34. FIG. 4(*b*) shows the valve hole 282 in a state closed by the valve body 29. In this state, the flow of refrigerant gas from the discharge chamber 132 to the control chamber 121 is stopped.

The first pressure chamber 301 is connected to the control chamber 121 through the third port 285 and the third passage 35. The second pressure chamber 302 is connected to the suction chamber 131 through the fourth port 286 and the fourth passage 36. Accordingly, the control pressure Pc of the control chamber 121 is communicated to the first pressure chamber 301, and the suction pressure Ps of the suction chamber 131 is communicated to the second pressure chamber 302.

The control pressure Pc communicated to the first pressure chamber 301 produces force P1, which is applied to the associated side of the diaphragm 31. The spring 32 produces force F, which is also applied to the same side of the diaphragm 31. The suction pressure Ps communicated to the second pressure chamber 302 generates force P2, which is applied to the other side of the diaphragm 31. The sum of forces P1 and F (P1+F) counters force P2. The difference between the forces applied to the opposite sides of the diaphragm {(P1+F)−P2} is such that the valve body 29 is urged in a direction opening the valve hole 282. During excitation of the solenoid 26, the urging force of the solenoid 26 counters the force resulting from the force differences {(P1+F)−P2}. As shown in FIG. 1, the current fed to the solenoid 26 is controlled by a controller 38 based on data sent from various devices such as an ambient temperature sensor 39, a speed sensor 40 for detecting the rotating speed of the drive shaft 14, and a temperature adjuster 41, which is employed to set the target temperature of the passenger compartment.

The size of the valve hole 282 and the flow rate of refrigerant gas sent to the control chamber 121 from the discharge chamber 132 are determined by the position of the valve body 29 with respect to the valve hole 282. The position of the valve body 29 is determined by the balance between the force resulting from the force difference {(P1+F)−P2} and the force of the solenoid 26.

When the solenoid 26 is excited with a constant current value, that is, when the force of the solenoid 26 is constant, the valve body 29 moves in accordance with fluctuations of the force difference {(P1+F)−P2} that affects the diaphragm 31 to steer the force difference {(P1+F)−P2} toward a predetermined value. For example, an increase in the suction pressure Ps decreases the force difference {(P1+F)−P2}. This weakens the force that opens the valve hole 282 and decreases the opened area of the valve hole 282. As a result, the amount of refrigerant gas that is sent to the control chamber 121 from the discharge chamber 132 decreases. This lowers the control pressure Pc of the control chamber 121 and thus decreases the difference between the control pressure Pc and the pressure of the compression chambers 112. As a result, the inclination of the swash plate 18 increases causing an increase in the displacement of the compressor and a gradual decrease in the suction pressure Ps. This returns the force difference {(P1+F)−P2} of the diaphragm 31 to the value it had been before the increase in the suction pressure Ps. Therefore, the force difference {(P1+F)−P2} seeks a predetermined value for a given solenoid force.

If the force of the solenoid 26 is constant and the suction pressure Ps decreases, the force difference {(P1+F)−P2} increases. This increases the force that opens the valve hole 282 and increases the opened area of the valve hole 282. Therefore, the amount of refrigerant gas that is sent to the control chamber 121 from the discharge chamber 132 increases and raises the control pressure Pc of the control chamber 121. Consequently, the inclination of the swash plate 18 decreases, which reduces the displacement of the compressor such that the suction pressure Ps increases gradually. This returns the force difference {(P1+F)−P2} of the diaphragm 31 to the value it had before the suction pressure Ps decreased.

Accordingly, the control valve 25 functions to maintain the force difference {(P1+F)−P2} of the diaphragm 31 at a predetermined value. In other words, the control valve 25 functions to maintain the difference between the control pressure Pc and the suction pressure Ps, or pressure difference Pc−Ps, at a predetermined constant value.

The control valve 25 changes the predetermined value of the pressure difference Pc−Ps, or the value of the target pressure difference, in accordance with the value of the current fed to the solenoid 26. For example, an increase in the value of the current fed to the solenoid 26 strengthens the force of the solenoid 26 that urges the valve body 29 in the closing direction. This decreases the opened area of the valve hole 282 and lowers the control pressure Pc of the control chamber 121. As a result, the compressor displacement increases and the suction pressure Ps decreases gradually. This consequently decreases the difference between the control pressure Pc and the suction pressure Ps (i.e., Pc−Ps). Thus, the control valve 25 maintains a smaller pressure difference (Pc−Ps) as the value of the current fed to the solenoid 26 increases. Accordingly, the control valve 25 functions to change the target pressure difference in accordance with the value of the current fed to the solenoid 26.

Figure 5A:
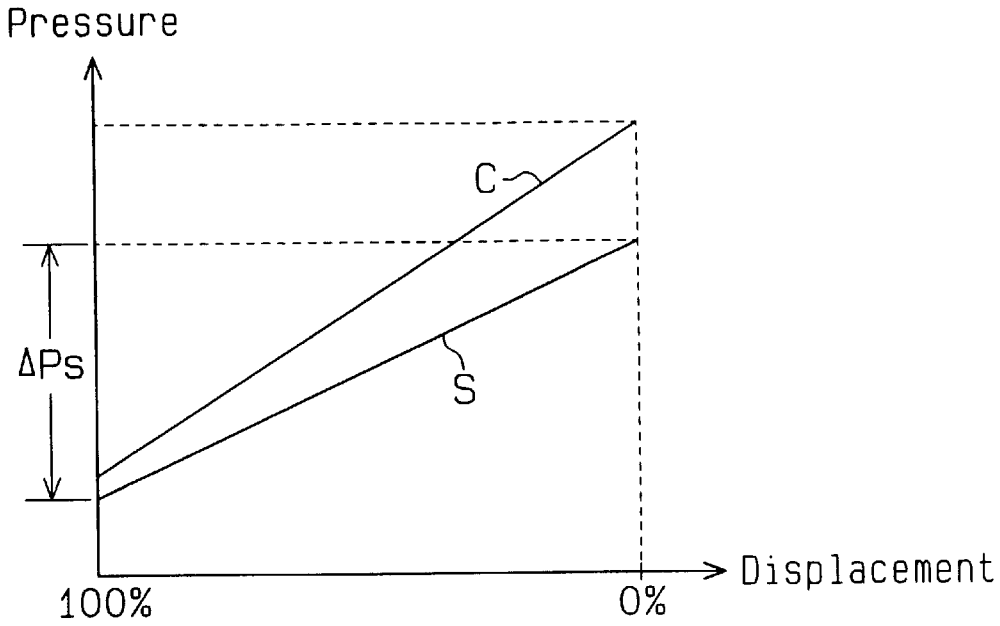
FIG. 5(*a*) is a graph illustrating the relationship of the compressor displacement relative to the suction pressure and the control pressure.
Figure 5B:
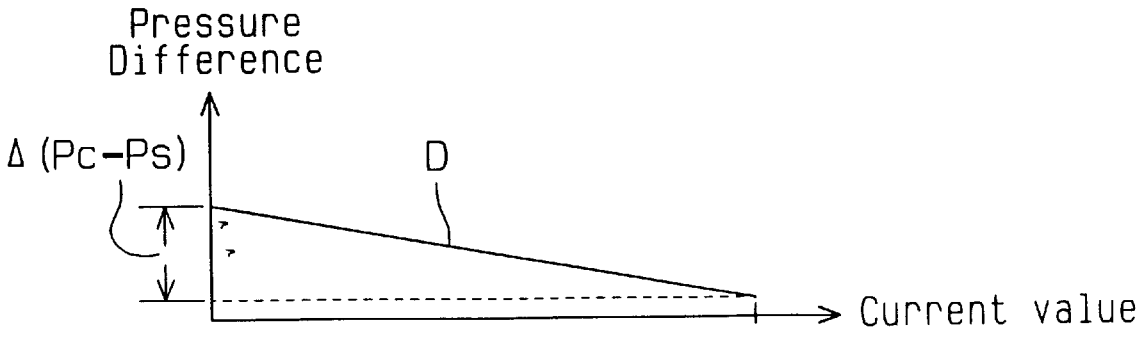
Figure 6:
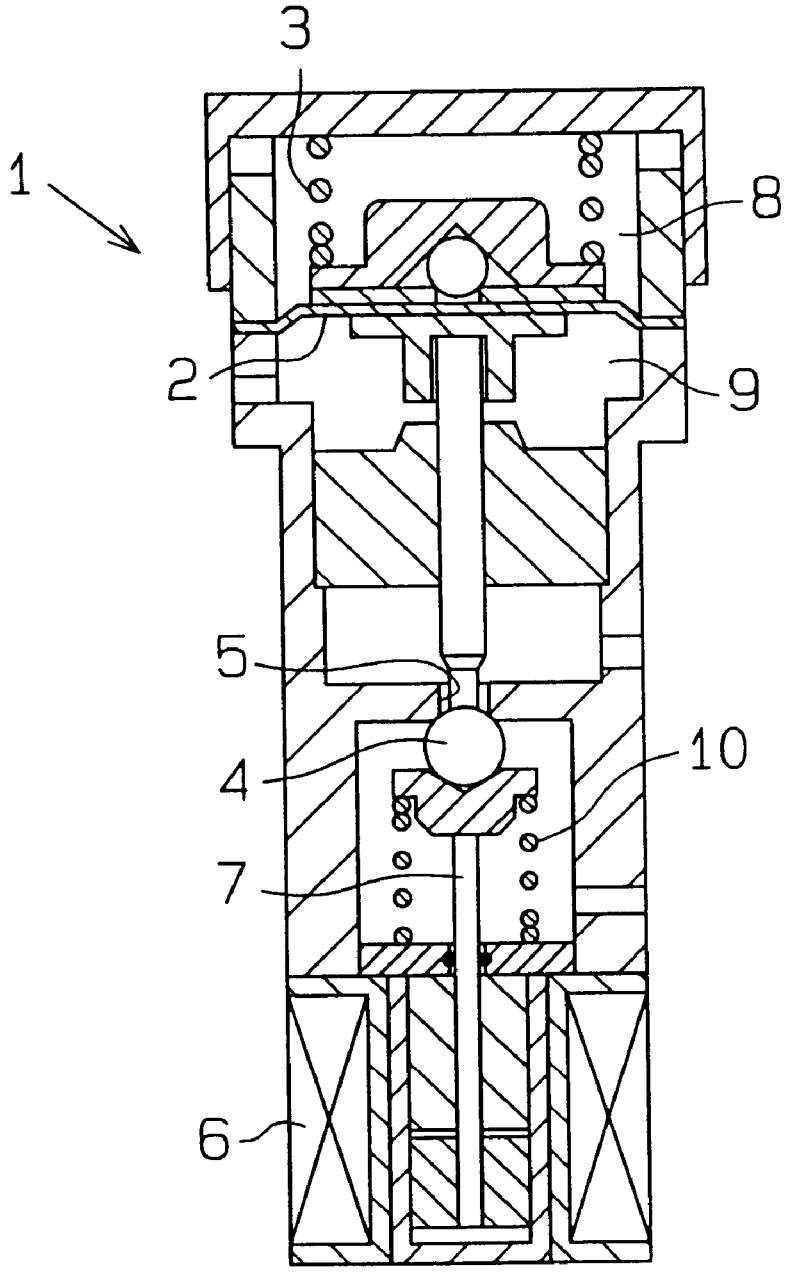
Fig.6 (Prior Art)
FIG. 6 is a cross-sectional view showing a prior art displacement control valve.

In the graph of FIG. 5(*a*), the line labeled S illustrates the relationship between the suction pressure Ps and the compressor displacement, and the line labeled C illustrates the relationship between the control pressure Pc and the compressor displacement. The graph of FIG. 5(*b*) shows the relationship between the pressure difference Pc−Ps and the value of the current fed to the solenoid 26. The control pressure Pc communicated to the first control chamber 301 counters the suction pressure Ps communicated to the second control chamber 302. Thus, the urging force fluctuating range ΔI of the solenoid 26, or the current value range ΔI of the solenoid 26, is generally proportional to the fluctuating range Δ(Pc−Ps) of the pressure difference Pc−Ps. The narrow range of the pressure difference range Δ(Pc−Ps) does not require a wide urging force fluctuating range ΔI. The fluctuating range Δ(Pc−Ps) of the pressure difference Pc−Ps is much smaller than the fluctuating rate ΔPs of the suction pressure Ps. Accordingly, the solenoid 26 of the displacement control valve 25 need not generate a large force and does not require a wide current range such as that required by the control valve illustrated in FIG. 6, in which the current value range ΔI is generally proportional to the suction pressure fluctuating range ΔPs. Thus, the displacement control valve 25 is more compact and light even if the variable displacement compressor is of a type that employs carbon dioxide as the refrigerant gas.

An increase in the thermal load raises the suction pressure Ps, while a decrease in the thermal load lowers the suction pressure Ps. The control valve 25 increases the compressor displacement by decreasing the opened area of the valve hole 282 when the suction pressure Ps increases, and decreases the compressor displacement by increasing the opened area of the valve hole 282 when the suction pressure Ps decreases. In this manner, the control valve 25 functions to answer the demand for an increase in the displacement when the thermal load increases and to answer the demand for a decrease in the displacement when the thermal load decreases. Accordingly, the control valve 25 performs feedback control of the displacement by directly using suction pressure Ps, which reflects the thermal load. This facilitates displacement control.

In the variable displacement compressor described in Japanese Unexamined Patent Publication No. 6-341378, the force of the solenoid arranged in the control valve becomes null when current cannot be fed to the solenoid. This closes the control valve and keeps the compressor displacement in a maximum state. When the maximum displacement state continues for a long period of time, the pressure of the refrigerant gas becomes abnormally high and shortens the life of the compressor. However, the control valve 25 of the present embodiment causes the urging force of the spring 32 to hold the valve body 29 at a position that completely opens the valve hole 282 when the flow of current to the coil 261 is stopped. Consequently, the compressor displacement decreases. Thus, the compressor does not maintain the maximum displacement state when the flow of current to the coil 261 stops. This extends the life of the compressor.

It is desirable that the solenoid 26 of the displacement control valve 25 be of a type having a high output and quick response.

It should be apparent to those skilled in the art that the present invention may be embodied in many other specific forms without departing from the spirit or scope of the invention. For example, the present invention may be embodied as described below.

In the preferred and illustrated embodiment, a bellows or spool may be employed as the pressure sensing element in lieu of the diaphragm 31.

In the preferred and illustrated embodiment, a piezoelectric element may be employed as the electric drive means in lieu of the solenoid 26.

Therefore, the present examples and embodiments are to be considered as illustrative and not restrictive, and the invention is not to be limited to the details given herein, but may be modified within the scope and equivalence of the appended claims.

What is claimed is:

1. A control valve for controlling displacement of a variable displacement compressor, wherein the compressor includes a suction pressure zone, the pressure of which is a suction pressure, a discharge pressure zone, a control chamber, the pressure of which is a control pressure, and a pressurizing passage through which refrigerant is sent to the control chamber from the discharge pressure zone, wherein the control valve adjusts the amount of refrigerant sent to the control chamber from the discharge pressure zone to control the compressor displacement such that the control pressure is raised and the compressor displacement is decreased when the amount of refrigerant sent to the control chamber from the discharge pressure zone increases, and the control pressure is lowered and the compressor displacement is increased when the amount of refrigerant sent to the control chamber from the discharge pressure zone decreases, wherein the control valve comprises:

a valve body for adjusting the opened area of the pressurizing passage;

an electric drive means for urging the valve body in a first direction with a force corresponding to the value of the current fed to the electric drive means;

a first pressure chamber to which the control pressure of the control chamber is communicated;

a second pressure chamber to which the suction pressure of the suction pressure zone is communicated; and a pressure sensing element partitioning the first pressure chamber and the second pressure chamber from each other, wherein the difference between the pressure of the first pressure chamber and the pressure of the second pressure chamber produces a force that causes the pressure sensing element to urge the valve body in a second direction, which is opposite to the first direction, wherein a target value of the pressure difference between the first and second pressure chambers is determined by the urging force of the electric drive means, the pressure sensing element moves the valve body to decrease the opened area of the pressurizing passage and return the pressure difference to the target value when the suction pressure communicated to the second pressure chamber increases, and the pressure sensing element moves the valve body to increase the opened area of the pressurizing passage and return the pressure difference to the target value when the suction pressure communicated to the second pressure chamber decreases.

2. The control valve according to claim 1, wherein the electric control means is arranged on a side of the valve body that is opposite to the pressure sensing element.

3. The control valve according to claim 2, wherein the valve body is constructed and arranged such that movement of the valve body in the first direction decreases the opened area of the pressurizing passage, and movement of the valve body in the second direction increases the opened area of the pressurizing passage.

4. The control valve according to claim 1 further comprising an urging means for holding the valve body at a position that keeps the pressurizing passage completely opened when the electric drive means is de-excited.

5. The control valve according to claim 4, wherein the urging means includes a spring arranged in the first pressure chamber.

6. The control valve according to claim 1, wherein the electric drive means includes a solenoid.

7. The control valve according to claim 1, wherein the refrigerant includes carbon dioxide.

8. A control valve for controlling displacement of a variable displacement compressor, wherein the compressor includes a suction chamber, the pressure of which is a suction pressure, a discharge chamber, a control chamber, the pressure of which is a control pressure, a pressure relief passage through which refrigerant is released into the suction chamber from the control chamber, and a pressurizing passage through which refrigerant is sent to the control chamber from the discharge chamber, wherein the control valve adjusts the amount of refrigerant sent to the control chamber from the discharge chamber to control the compressor displacement such that the control pressure is raised and the compressor displacement is decreased when the amount of refrigerant sent to the control chamber from the discharge chamber increases, and the control pressure is lowered and the compressor displacement is increased when the amount of refrigerant sent to the control chamber from the discharge chamber decreases, wherein the control valve comprises:

a valve body for adjusting the opened area of the pressurizing passage;

a solenoid for urging the valve body in a first direction with a force corresponding to the value of the current fed to the solenoid, wherein movement of the valve body in the first direction decreases the opened area of the pressurizing passage;

a first pressure chamber to which the control pressure of the control chamber is communicated;

a second pressure chamber to which the suction pressure of the suction chamber is communicated; and a pressure sensing element partitioning the first pressure chamber and the second pressure chamber from each other, wherein the solenoid is arranged on a side of the valve body that is opposite to the pressure sensing element, wherein the difference between the pressure of the first pressure chamber and the pressure of the second pressure chamber produces a force that causes the pressure sensing element to urge the valve body in a second direction, which is opposite to the first direction, wherein a target value of the pressure difference between the first and second pressure chambers is determined by the urging force of the solenoid, the pressure sensing element moves the valve body to decrease the opened area of the pressurizing passage and return the pressure difference to the target value when the suction pressure communicated to the second pressure chamber increases, and the pressure sensing element moves the valve body to increase the opened area of the pressurizing passage and return the pressure difference to the target value when the suction pressure communicated to the second pressure chamber decreases.

9. The control valve according to claim 8 further comprising an urging means for holding the valve body at a position that keeps the pressurizing passage completely opened when the solenoid is de-excited.

10. The control valve according to claim 9, wherein the urging means includes a spring arranged in the first pressure chamber.

11. The control valve according to claim 8, wherein the refrigerant includes carbon dioxide.

* * * * *